United States Patent [19]

Rowe

[11] Patent Number: 4,996,734

[45] Date of Patent: Mar. 5, 1991

[54] T-SHAPED PILLOW WITH NECK SUPPORTING PORTION

[76] Inventor: Shelba D. Rowe, 1215 Council, Ontario, Calif. 91754

[21] Appl. No.: 515,645

[22] Filed: Apr. 25, 1990

Related U.S. Application Data

[63] Continuation of Ser. No. 814,602, Dec. 10, 1987, abandoned, which is a continuation of Ser. No. 563,286, Dec. 13, 1983, abandoned.

[51] Int. Cl.[5] ..... A47G 9/00

[52] U.S. Cl. ..... 5/434; 5/436

[58] Field of Search ..... 5/434–442

[56] References Cited

U.S. PATENT DOCUMENTS

| | | | |
|---|---|---|---|
| 2,700,779 | 2/1955 | Tolkowsky | 5/434 |
| 3,521,310 | 7/1970 | Greenawalt | 5/436 |
| 3,849,810 | 11/1974 | Degen | 5/442 |
| 4,017,118 | 4/1977 | Cawley | 5/440 |
| 4,424,599 | 1/1984 | Hannouche | 5/434 |
| 4,432,107 | 2/1984 | Clark et al. | 5/434 |

*Primary Examiner*—Michael F. Trettel

*Attorney, Agent, or Firm*—John E. Wagner; Theodore H. Lassagne

[57] ABSTRACT

An improved pillow having a head supporting portion and a neck supporting portion. The neck supporting portion having a firmness greater than the head supporting portion. The neck supporting portion is of lesser transverse dimension than the head supporting portion to allow freedom from interference of the pillow with the sleeper's jaw and mouth. In an alternate version, the pillow includes two reversible neck supporting portions of different firmness.

1 Claim, 1 Drawing Sheet

T-SHAPED PILLOW WITH NECK SUPPORTING PORTION

This is a continuation of copending application Ser. No. 06/814,602, filed on 12-10-87, now abandoned, which is in turn a continuation of previous application Ser. No. 06/563,286, filed on 12-13-83, now abandoned.

BACKGROUND OF THE INVENTION

The pillow has undoubtedly been with man for longer than recorded history. Most persons prefer to have their head elevated slightly above the level of their body while sleeping. The classic down filled or foam pillows have traditionally been designed as a rectangle or in some cases other shapes have been used such as round, square or other ornamental shapes. Some pillows are even made up of two parts, one being a soft face and the opposite a firmer face.

It is interesting to note that nowhere in the prior art is a recognition that an optimum pillow must take into account that there are two parts of the anatomy which need to be supported by the pillow, namely the neck as well as the head and that each are at a different level when lying on one's back and each require a different degree of support for greatest comfort. The neck is usually supported by the pillow, only if the pillow is soft enough so that the depression caused by the head is sufficient that the neck is supported. Usually the neck is in contact with the pillow but the predominant support is applied to the back of the head and only lesser support is given to the neck. The net result is a slight upward pressure on the neck which can result in discomfort.

Additionally, most pillow designs do not take into account the fact that many persons like to sleep on their side but do not desire that their face and mouth be obstructed. Some very soft pillows actually obstruct the sleepers mouth if they attempt to sleep on their side. At best, the typical average firmness pillow puts significant side pressure on the jaw of the sleeper. This is not recognized by many as a problem except those with a need to wear orthodontic headgear or other with dental or jaw problems. Such persons, heretofore, have not been able to find an acceptable pillow which will allow them to lie on their side while sleeping. I am one of those persons.

BRIEF DESCRIPTION OF THE INVENTION

Faced with this state of the art, and my very real needs, I sought to design a pillow which provides support for the neck which more nearly matches its needs, namely either a slightly higher level than the head supporting portion or of slightly greater firmness than the head supporting portion. This is achieved with a pillow having a front edge of different firmness from the remainder of the pillow body.

In order to leave the sleeper's mouth and jaw free from interference from the pillow, I have designed a T-shaped pillow with the head of the T supporting the sleeper's head and the body of the T supporting the sleeper's neck. In one embodiment, the body of the T is of greater firmness than the remainder of the pillow.

In another embodiment of this invention, the pillow is cruciform in shape with two shorter arms intended for neck support and the longer arms defining the main body of the pillow for head support. One of the shorter arms is of greater firmness than the main body of the pillow. This embodiment provides not only additional neck support for those who recognize this need, normal or equal firmness in the reverse configuration but freedom from jaw and mouth interference when used in either manner.

BRIEF DESCRIPTION OF THE DRAWING

This invention may be more clearly understood from the following detailed description and by reference to the drawing in which.

DETAILED DESCRIPTION OF THE INVENTION

Figure 1:
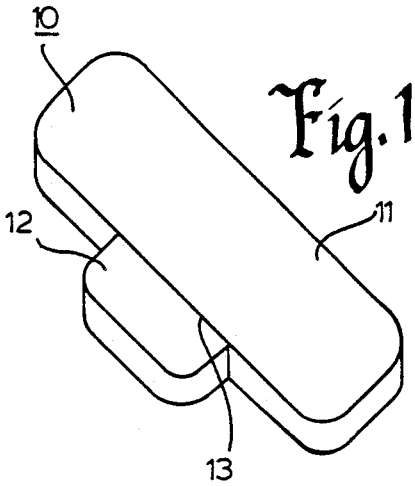
FIG. 1 is a perspective view of one embodiment of this invention.

Referring now to the drawing, a pillow construction in accordance with my invention may be seen. The pillow, generally designated 10, includes a main body portion 11 and a neck supporting portion 12, joined in this embodiment at joint 13. The main body portion 11 and the neck supporting portion 12 are each made of polyurethane foam only of different degrees of firmness; the neck supporting portion having the greater firmness.

Overall the pillow 10, of FIG. 1 is generally T-shaped with the portion 11 corresponding to the head of the T and the neck supporting portion 12 constituting the body of the T. Of course, it is obvious in the drawing that the neck portion 12 is smaller than the head portion 11, and is shorter in the longitudinal direction, measured in the direction of the users spine. The neck portion 12 has a length in this direction of 3 to 5 inches which is sufficient to provide support for the neck. The head portion 11 is longer than the neck portion 12 measured in the same direction, e.g. 8 inches or longer. Excess length of the head supporting portion 11 is optional.

Figure 4:
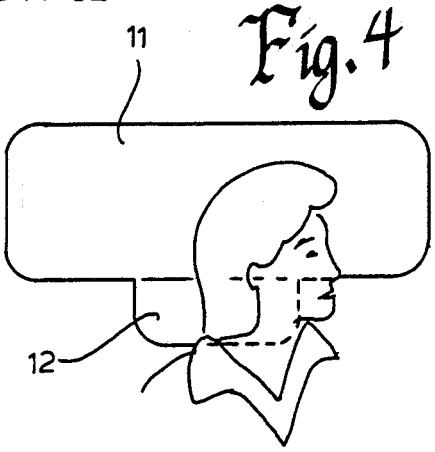
FIG. 4 is a top plan view of the embodiment of FIG. 1 being used by a sleeper on their side.

It is important to note that the head supporting portion 11 is wider than the neck supporting portion 12 resulting in a major feature of the invention. The head supporting portion 11 is at least 8 inches in width dictated by the possibility that sleepers lie on their sides with the side of their face against the pillow. Note that the neck supporting portion 12 is slightly wider than the sleeper's neck. When the sleeper turns to either side, as illustrated in FIG. 4, his head is supported, but his chin and mouth area are not in contact with the pillow 10, at all. For those who do not like side at pressure on their jaw or their mouth partially buried in the pillow, this new design of pillow provides comfort not heretofore available.

For those who must wear orthodontic headgear, i.e. external bracing, one not only provides superior comfort for the sleeper, but it allows such persons to lie on their side on a pillow while wearing headgear for the first time. They also have the privilege of having greater neck support than head support by reason of the dual density or firmness feature described above.

Figure 5:
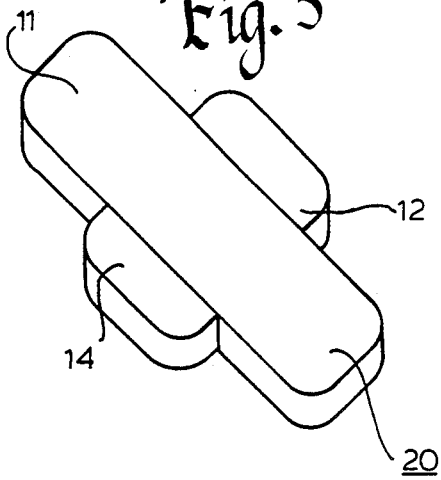
FIG. 5 is a perspective view of an alternate embodiment of this invention.
Figure 2:
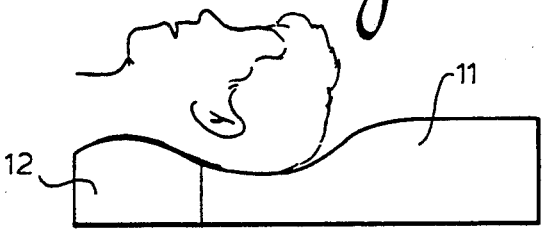
FIG. 2 is an end view of the embodiment of FIG. 1 in use.
Figure 6:
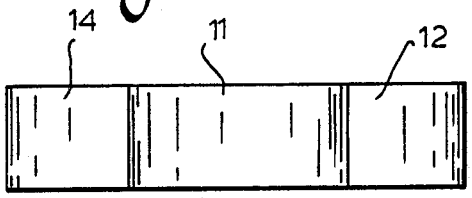
FIG. 6 is an end elevational view of the embodiment of FIG. 5.

For those who are unaccustomed to greater neck support than head support and want the feature of no jaw and mouth obstruction, the embodiment of FIG. 5 is particularly valuable. The embodiment of FIG. 5 is generally cruciform in shape with a head supporting portion 11 and a neck supporting portion 12 of greater firmness than the head supporting portion 11 and an additional neck supporting portion 14 which is used by reversing the pillow 20 as shown in FIG. 5. The neck supporting portion 14 is of different firmness from the neck supporting portion 12. It may be of the same firmness as the head supporting portion 11 or of greater or lesser firmness than the head supporting portion 11. This is illustrated in FIG. 7 by the dashed lines indicating different degrees of firmness.

Figure 3:
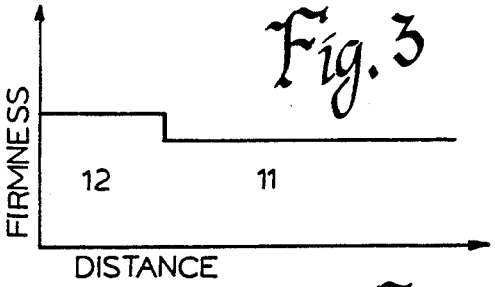
FIG. 3 is graphical presentation, relative firmness of this invention showing the neck and head supporting portions.

FIG. 3 illustrates the differential firmness of the pillow of FIG. 1 graphically. Firmness is illustrated in the ordinate direction and distance from the front of the pillow is represented in the abscissa direction. The area 12 of the neck supporting portion is shown having a greater firmness and the head supporting portion having lesser firmness. The abrupt change in stiffness appears at joint 13 of FIG. 1.

Figure 7:
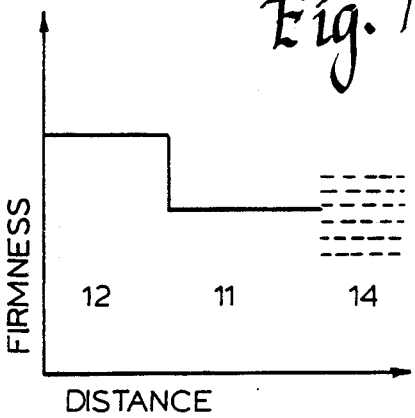
FIG. 7 is a graphical representation of the relative firmness of each of the embodiments of FIG. 5 of this invention.

In FIG. 7 a transition exists at the joint 13 where the greater stiffness neck supporting portion 12 joins the lesser stiffness of the head supporting portion 11. The firmness of alternate neck supporting portion 14 may be greater, equal to, or less than the firmness of the head supporting portion 11 as may be desired. This is illustrated by dashed lines. A lesser firmness as illustrated by section (14) is not consistent with my basic desire but conceivably one might want graduated firmness from neck to head. This is possible using the combination of portion 12, portion 11 and portion 14.

In carrying out the preferred embodiment of this invention shown in FIG. 1, I employed the following material:

| | |
|---|---|
| Neck supporting portion 12 | Polyurethane foam 1.45#/ft$^3$ Firmness: Soft. e.g. Indentation Load Deflection (ILD rating) of #22–28 using ASTM or equivalent test method to provide a 25% compression on a 4" thick foam sample with the weight applied as 8" × 8" steel plate. |
| Head supporting portion 11 | polyurethane foam 1.45#/ft$^3$ Firmness: Supersoft e.g. (ILD rating) of #15–21 as identified above. |

-continued

| | |
|---|---|
| Joint | STABOND MS-230 adhesive of the Stabond Corp of Gardena, CA 90249 |

Typical dimensions for a pillow made in accordance with my invention are:

| DIMENSIONS | | USEFUL RANGE |
|---|---|---|
| width of 11 | 25" | 12" or greater |
| length of 11 | 9" | 8" or greater |
| height of pillow | 4" | 2" to 4" |
| width of 12 and 14 | 11" | 5" to 11" |
| length of 12 and 14 | 3½" | 3" to 5" |

I do recognize that it is possible using controlled foaming techniques to vary the density of foam in a single foam plastic body. Such a technique could be applied to my invention to provide differential firmness with the neck supporting portion having greater firmness than the head supporting portion. In such case the abrupt firmness noted in FIGS. 3 & 7 will not occur, but more gradual changes will be present.

In each of the embodiments, the pillows are shown with right angle corners, for ease of manufacture by cutting of the foam plastic. It must be recognized that the pillow may be shaped at their edges, if desired, without changing their functional relationship of the pillow sections.

The above described embodiments of this invention are merely descriptive of its principles and are not to be considered limiting. The scope of this invention instead shall be determined from the scope of the following claims, including their equivalents.

I claim:

1. An improved pillow comprising a generally T-shaped body of resilient material proportioned to typical head and neck portions of a human user's anatomy, with a head supporting portion constituting the head of the T and a neck supporting portion constituting the body of the T; the head supporting portion and the neck supporting portion being of the same general thickness with the neck supporting portion being permanently secured to the head supporting portion, the head supporting portion being of sufficient width to support the user's head when it is positioned either face up or rolled from face up position onto either side, and the neck supporting portion being of greater firmness than the head supporting portion whereby the head of a user will depress the head supporting portion to a greater extent than the neck supporting portion is depressed while maintaining the user's jaw region clear of both said neck and head supporting portions and of the pillow's support when the user rests on the user's back or turned to either side.

* * * * *